US006540563B1

(12) United States Patent
Hu et al.

(10) Patent No.: US 6,540,563 B1
(45) Date of Patent: Apr. 1, 2003

(54) STACKED CONNECTOR ASSEMBLY

(75) Inventors: Jinkui Hu, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,454

(22) Filed: Dec. 27, 2001

(30) Foreign Application Priority Data

Dec. 21, 2001 (TW) ..... 090222541

(51) Int. Cl.[7] ..... H01R 24/06
(52) U.S. Cl. ..... 439/676; 439/541.5; 439/607
(58) Field of Search ..... 439/541.5, 696, 439/701, 607, 609, 540.1

(56) References Cited

U.S. PATENT DOCUMENTS 5,639,267 A * 6/1997 Loudermilk ..... 439/701
6,080,011 A * 6/2000 Tsao et al. ..... 439/541.5
6,206,725 B1 * 3/2001 Wu ..... 439/541.5
6,402,563 B1 * 6/2002 Shi et al. ..... 439/676

* cited by examiner

*Primary Examiner*—Hien Vu
(74) *Attorney, Agent, or Firm*—Wei Te Chung

(57) ABSTRACT

A stacked connector assembly (1) comprises an insulative housing (10) defining a first and a second apertures (13, 14) in a mating face and a number of inner and outer recesses (180, 182) in a rear face (122), a first connector (20) disposed in the first aperture, a second connector (30) disposed in the second aperture, and a spacer (5) fixed to the housing. The second connector includes an array of second terminals (31) having second right-angle bent tails (314) received in the outer and inner recesses of the housing. The spacer is formed with a plurality of projections (510) abutting against the second right-angle bent tails that are received in the inner recesses of the housing, and a plurality of channels (512) having inside faces (5120) for abutting against the second right-angle bent tails that are received in the outer recess.

5 Claims, 9 Drawing Sheets

STACKED CONNECTOR ASSEMBLY

BACKGROUND OF THE INVENTION

1. Field of the Invention

The present invention relates to a stacked connector assembly, and particularly to a stacked connector assembly having a spacer for conveniently and stably retaining terminals in an insulative housing thereof.

2. Description of Related Art

A computer is required to provide connectors at input/output ports, which are usually mounted on a main printed circuit board (PCB) thereof, to mate with corresponding complementary connectors of peripheral devices for signal transmission therebetween. In order to sufficiently utilize limited area of the main PCB, the electrical connectors are usually arranged in a stacked manner. A conventionally stacked connector assembly has an upper and a lower receiving cavities in a mating face thereof. A plurality of first and second terminals are respectively disposed in the upper and the lower receiving cavities. Each first and second terminal includes a front contacting portion for engaging with a corresponding terminal of an inserted complementary connector, and a rear right-angle tail portion for electrical connection with a printed circuit board. However, because the rear right-angle tail portions of the first terminals connected with the PCB are too long, the rear tail portions of the first terminals are easy to warp when the complementary connectors are inserted into or pulled out from the stacked connector assembly. This will cause the stacked connector assembly to incline. As a result, the electrical connection between the stacked connector assembly and the complementary connectors may be unreliable and the quality of signal transmission therebetween may be adversely affected.

U.S. Pat. No. 6,162,089 discloses a stacked connector assembly which has a fixing device for retaining terminals. The stacked connector assembly defines a dual-lower USB (Universal Serial Bus) receiving cavity and an upper modular jack receiving cavity vertically stacked in a mating face thereof. Terminals disposed in the upper receiving cavity are assembled with insert-molded front and rear inserts, wherein the rear insert functions as a fixing device. The front and the rear inserts are molded around the terminals in a common plane with carrier strips severed from opposite ends of the terminals. Front contacting portions of the terminals are angled rearwardly from front nose of the front insert. The rear insert is downwardly bent to be formed at a right angle with respect to the front insert, whereby rear right-angle tail portions of the terminals embedded in the rear insert are formed. Thereafter, the front and the rear inserts with the terminals retained therein are assembled to the housing in which the contacting portions of the terminals are received in the upper jack receiving cavity and the rear insert is fixed on the housing. Thus, the right-angle tail portions of the terminals are retained in the housing by the rear insert.

However, before molding the rear insert, the terminals must be positioned in a mold via positioning mechanisms to ensure an accurate pitch between adjacent terminals, thus increasing the difficulty of manufacturing the rear insert. Due to inherent factors, such as size of the terminals, when molten plastic is injected into the mold to form the rear insert, the terminals are easily displaced to result in an inaccurate pitch between the adjacent terminals such that the electric capability of the terminals may be adversely affected, such as a cross-talk may be occurred. On the other hand, because the rear insert is integrally molded with the terminals, the rear insert cannot be reused and it will increase the cost of manufacturing the stacked connector assembly.

Hence, a stacked connector assembly having a spacer is required to overcome the disadvantages of the related art.

SUMMARY OF THE INVENTION

Accordingly, the main object of the present invention is to provide a stacked connector assembly having a spacer for conveniently and stably retaining terminals in an insulative housing thereof, thereby ensuring a reliable electrical connection between the stacked connector assembly and complementary connectors.

Another object of the present invention is to provide a spacer for a stacked connector assembly wherein the spacer is easy to make and is conveniently secured to an insulative housing of the stacked connector assembly.

In order to achieve the object set forth, a stacked connector assembly having a spacer in accordance with the present invention comprises an insulative housing defining a first and a second apertures in a mating face thereof, a first electrical connector disposed in the first aperture, a second electrical connector disposed in the second aperture, and a spacer fixed to the housing. The housing defines a concavity in a rear face and a plurality of staggered inner and outer recesses communicating with the concavity. The first electrical connector includes at least one first receiving cavity in communication with the mating face of the housing, and a first array of terminals having first contacting portions extending into each at least one first receiving cavity of the first electrical connector and first right-angle bent tails adapted for electrical connection with a printed circuit board. The second electrical connector includes a second receiving cavity in communication with the mating face of the housing and a second array of terminals having second contacting portions extending into the second receiving cavity and second right-angle bent tails received in the inner and outer recesses of the housing in a staggered manner. The spacer is assembled to the concavity of the housing and has a plurality of projections abutting against the second right-angle bent tails that are received in the inner recesses of the housing, and a plurality of channels having inside faces for abutting against the second right-angle bent tails that are received in the outer recesses.

Other objects, advantages and novel features of the invention will become more apparent from the following detailed description when taken in conjunction with the accompanying drawings.

DETAILED DESCRIPTION OF THE INVENTION

Figure 1:
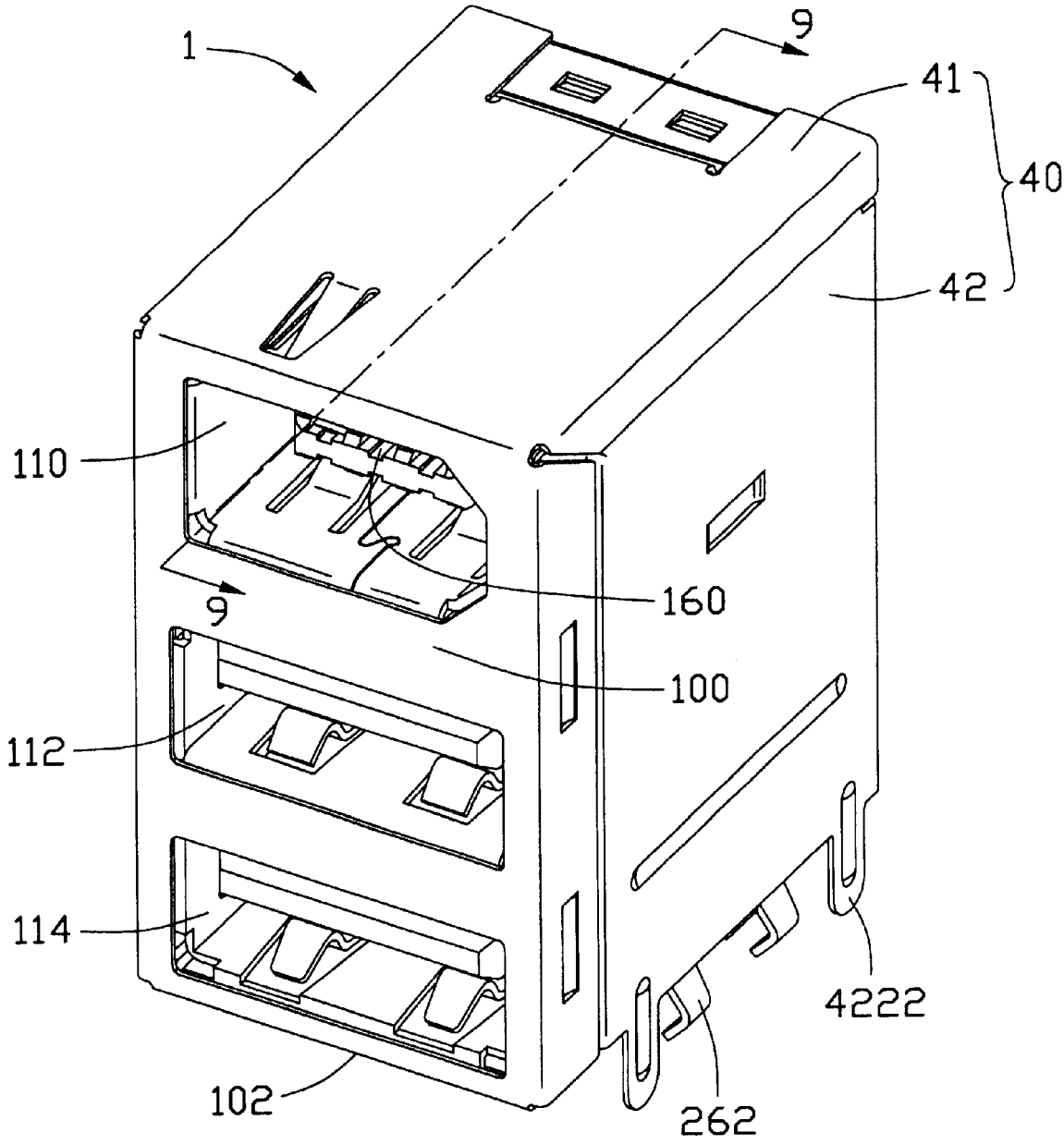
FIG. 1 is a front, perspective view of a stacked connector assembly having a spacer in accordance with the present invention.
Figure 2:
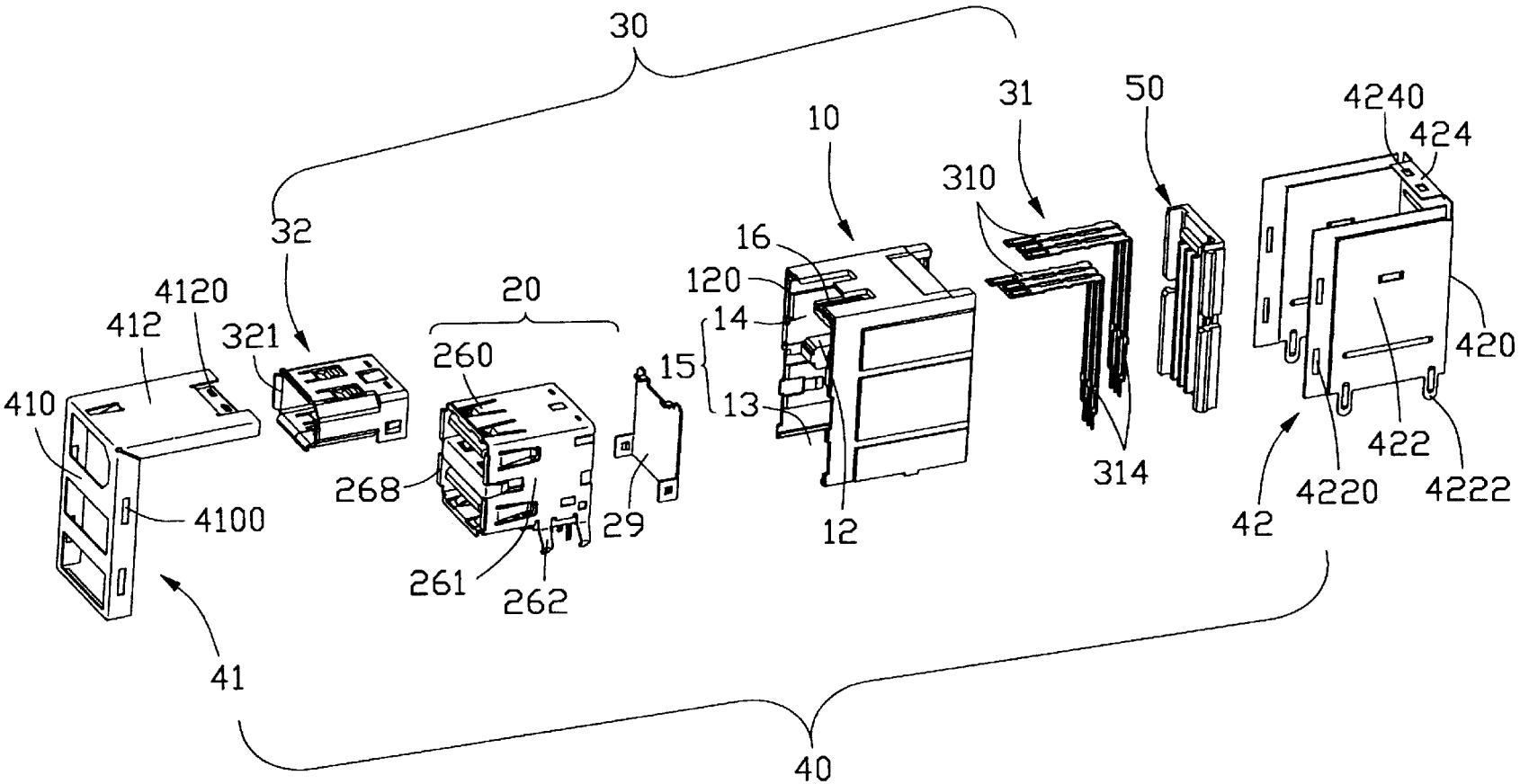
FIG. 2 is an exploded view of the stacked connector assembly of FIG. 1.
Figure 3:
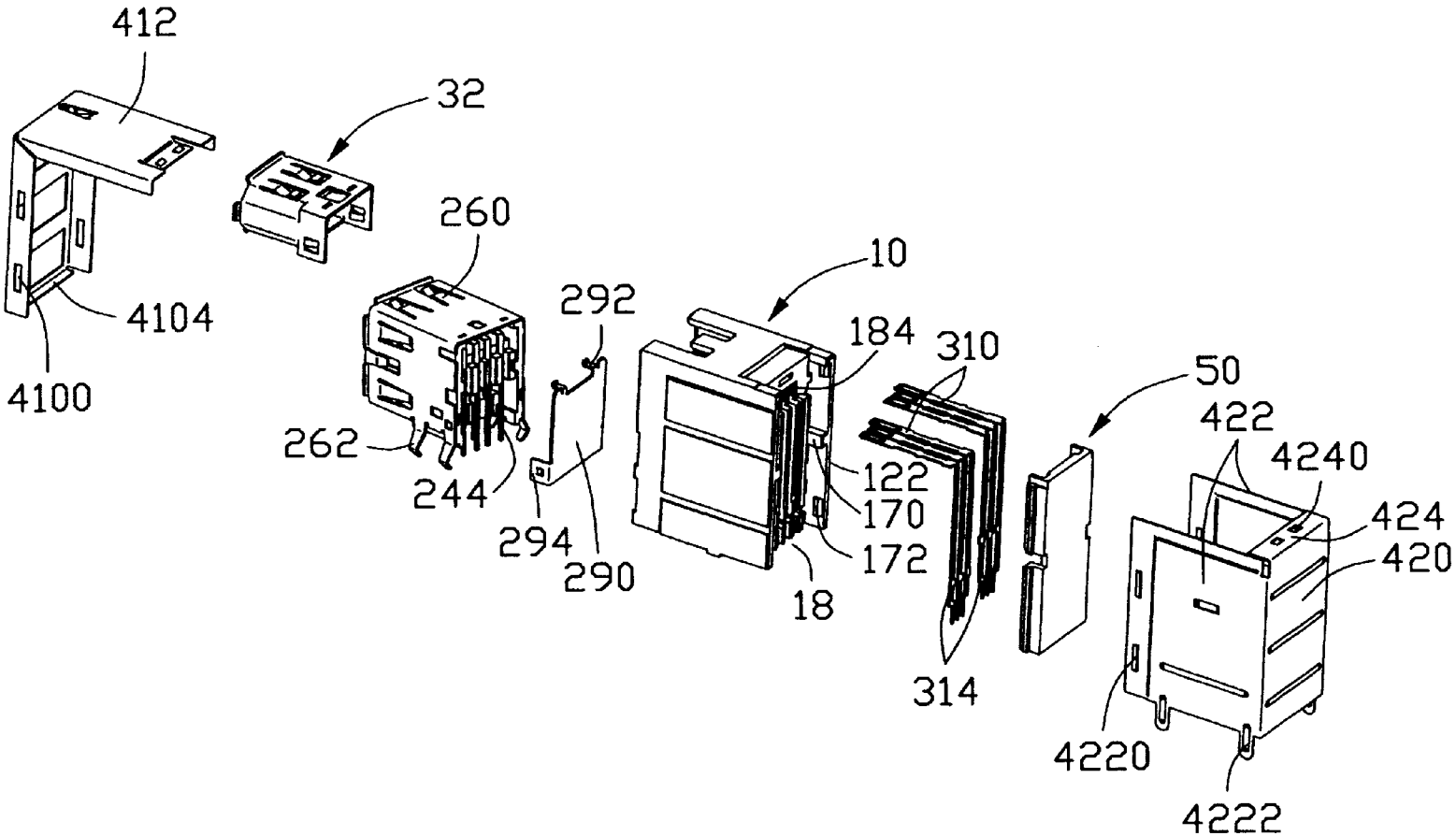
FIG. 3 is a view similar to FIG. 2 but taken from a different perspective.
Figure 4:
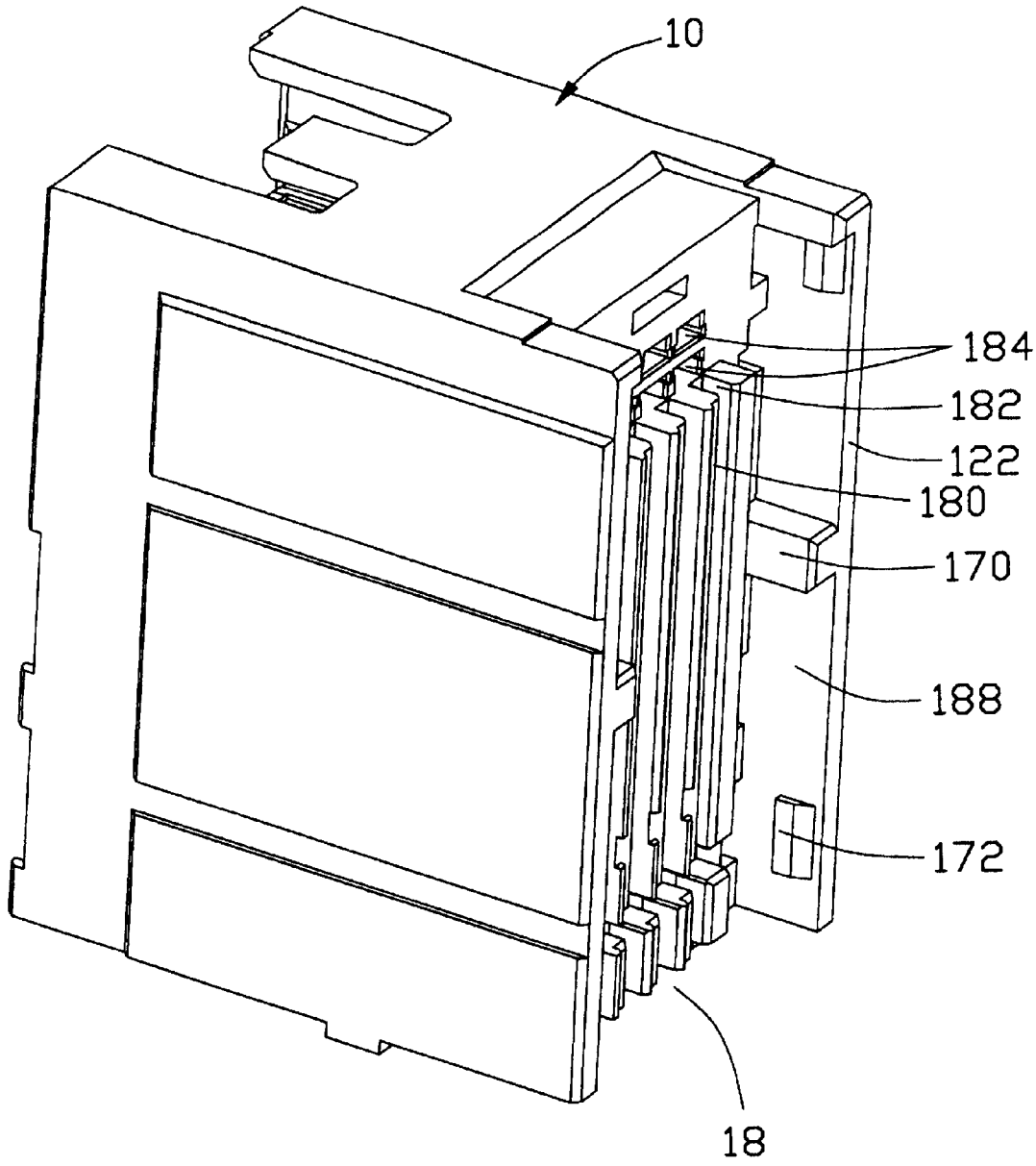
FIG. 4 is an enlarged, perspective view of an insulative housing of the stacked connector assembly.

Referring to FIGS. 1–4, a stacked connector assembly 1 in accordance with the present invention defines an IEEE 1394 (Institute of Electrical and Electronics Engineers) receiving cavity 110 and a pair of USB (Universal Serial Bus) receiving cavities 112, 114 vertically stacked in a mating face 100 thereof. The connector assembly 1 has a board-mounting face 102 orthogonal to the mating face 100. The stacked connector assembly 1 comprises an insulative main housing 10, a stacked USB component 20, an IEEE 1394 component 30, an outer shield 40 enclosing the main housing 10, and a spacer 50 connected to the main housing 10.

The main housing 10 is generally cubic in shape defining an aperture 15 in a front face 120 thereof. The aperture 15 is divided into a first and a second apertures 13, 14 by a tongue 12 for respectively accommodating the USB component 20 and the IEEE 1394 component 30 therein. The main housing 10 has a protrusion 132 (FIG. 9) extending forwardly into the first aperture 13 to define a first slot 134 (FIG. 9) thereabove, and an extension 16 extending forwardly into the second aperture 14. The extension 16 defines a plurality of passageways 160 in a top and a bottom faces thereof. The main housing 10 defines a concavity 18 in a rear face 122 for accommodating the spacer 50, a plurality of outer and inner recesses 180, 182 extending in two rows in a staggered manner and communicating with the concavity 18, and a plurality of holes 184 arranged in an upper and a lower rows respectively corresponding to the outer recesses 180 and the inner recesses 182. A pair of horizontally aligned bumps 170 are formed on opposite side faces 188 of the concavity 18. The main housing 10 also defines a channel (not shown) on one side face 188 of the concavity 18 and has a rib 172 formed on another side face 188.

Figure 5:
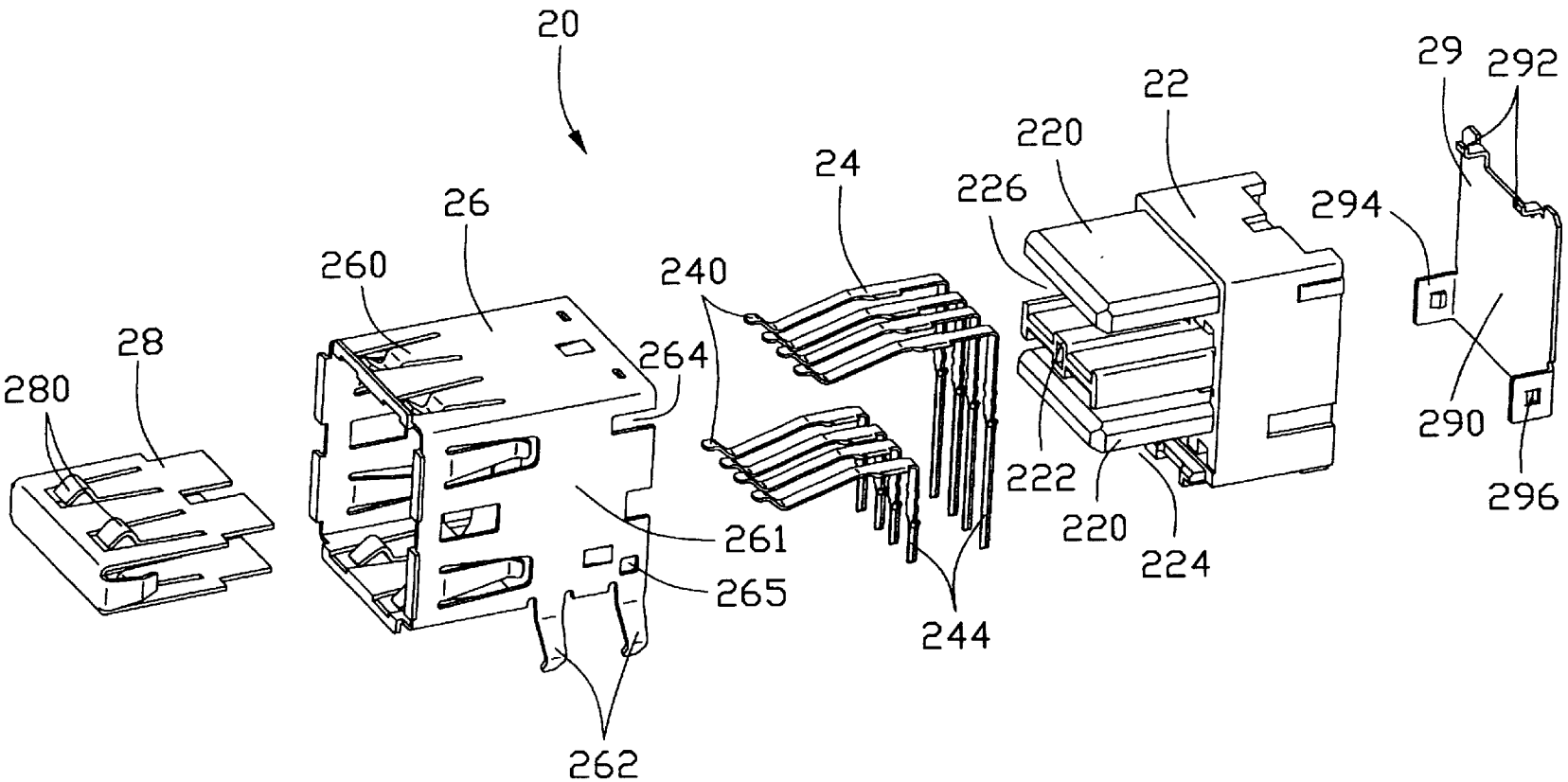
FIG. 5 is an exploded view of a stacked USB component of the stacked connector assembly.

Further referring to FIG. 5, the stacked USB component 20 comprises an insulative housing 22, a plurality of first terminals 24, an outer shield 26, an inner shield 28, and a rear shield 29. The housing 22 has a pair of support walls 220 and a partition 222 extending therebetween. A pair of plug-receiving cavities 224, 226 are defined by the support walls 220 and the partition 222. The first terminals 24 include first contacting portions 240 disposed along the support walls 220 and exposed in the plug-receiving cavities 224, 226 for electrically engaging with corresponding terminals of USB plug connectors (not shown), and first right-angle bent tails 244 extending beyond the board-mounting face 102 for electrical connection with a printed circuit board (not shown). The inner shield 28 includes spring arms 280 extending along the partition 222 to engage a shield of the USB plug connector along one side for grounding. The outer shield 26 includes spring arms 260 to engage the shield of the USB plug connector along an opposite side for ensuring a reliable grounding effect. The outer shield 26 further includes ground legs 262 for initial board retention and for electrical connection with ground circuits of the printed circuit board.

The rear shield 29 is provided to be secured to the outer shield 26 of the stacked USB component 20 along a rearward end thereof. The rear shield 29 includes a rear plate 290, a pair of forwardly extending fingers 292 adjacent to a top edge of the rear plate 290, and a pair of locking sections 294 with strips 296 integrally punched therefrom extending forwardly from side edges of the rear plate 290. The fingers 292 are received in cutouts 264 defined in the outer shield 26. The locking sections 294 extend along outer surfaces of side walls 261 of the outer shield 26 and the strips 296 are seated in openings 265 of the outer shield 26, thereby locking the rear shield 29 along the rearward end of the USB stacked component 20.

Figure 9:
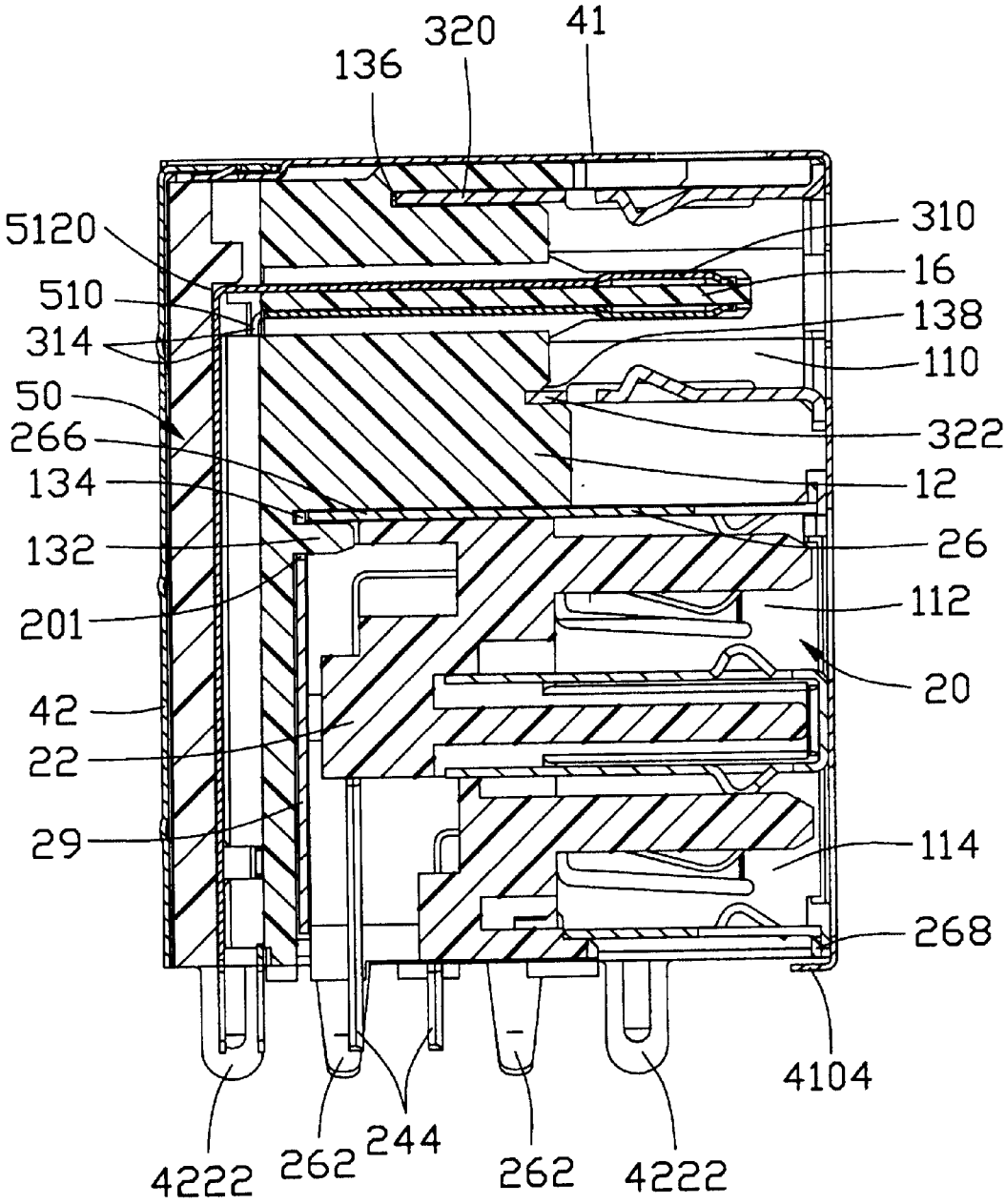
FIG. 9 is a cross-sectional view of the stacked connector assembly taken along section line 9—9 in FIG. 1.

The stacked USB component 20 is disposed in the first aperture 13 of the main housing 10 as indicated in FIG. 9. The protrusion 132 of the main housing 10 is received in an opening 201 of the USB component 20 that is formed by the outer shield 26 and the rear shield 29; the first slot 134 receives thereinto a rear potion 266 of an upper wall of the outer shield 26, thereby establishing fixing of the USB component 20 against movement in a vertical direction. On the other hand, side walls of the first aperture 13 restrain movement of the USB component 20 in a side-to-side direction.

The IEEE 1394 component 30 comprises a plurality of second terminals 31 and a shield 32. The second terminals 31, which are inserted into the main housing 10 via the holes 184, include second contacting portions 310 received in the passageways 160 of the extension 16, and second right-angle bent tails 314 respectively received in the outer and the inner recesses 180, 182 in a staggered manner for electrical connection with the printed circuit board. A rear portion 320 of a top wall of the shield 32 is received in a second slot 136 of the main housing 10; and a rear portion 322 of a bottom wall of the shield 32 is received in a third slot 138 defined in the tongue 12 of the main housing 10, thereby restraining movement of the shield 32 in a vertical direction. On the other hand, side walls of the second aperture 14 restrain movement of the shield 32 in a side-to-side direction.

Figure 6:
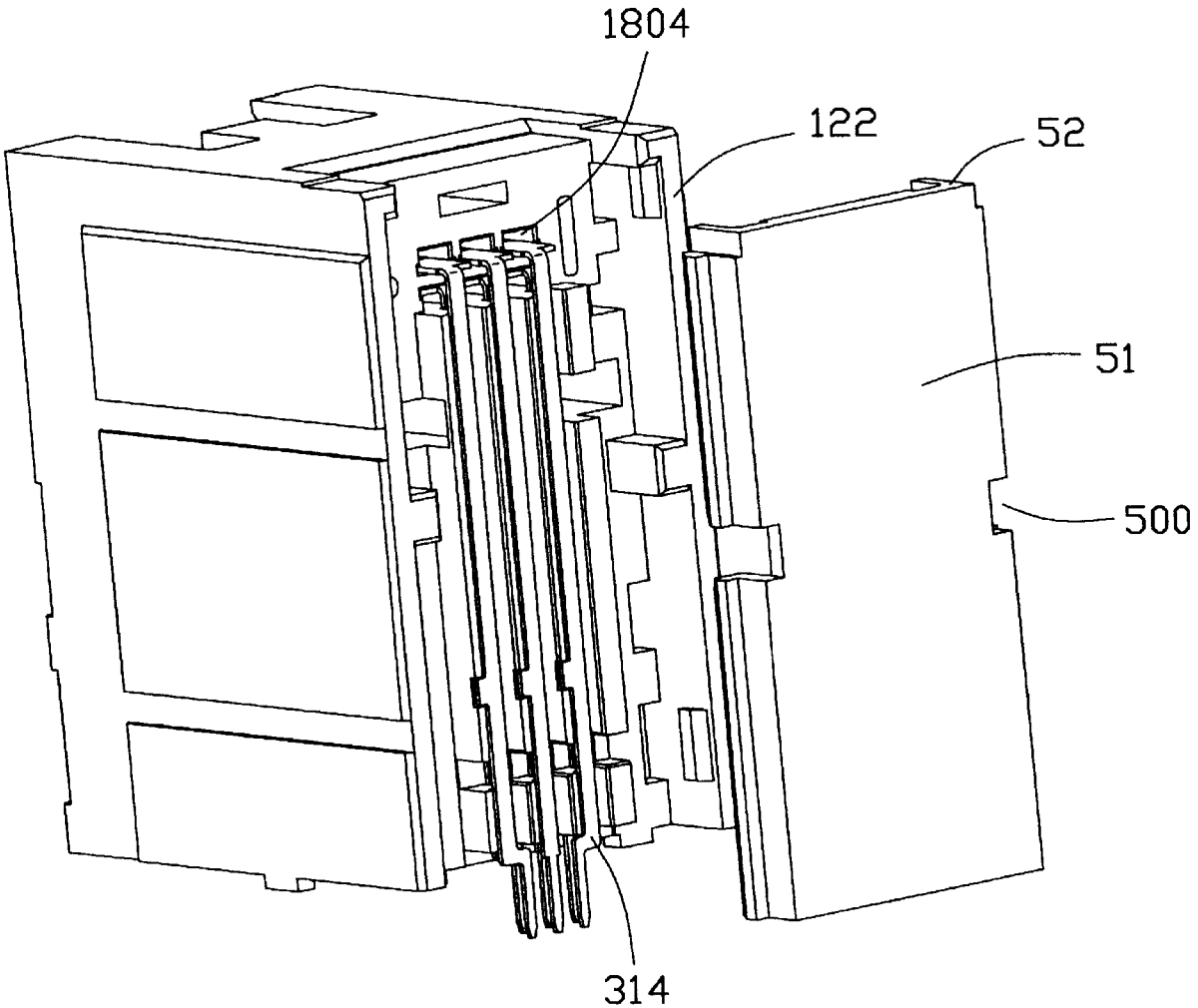
FIG. 6 is a rear, perspective view of the stacked connector assembly prior to assembly of an outer shield, showing the spacer disconnected to the housing.
Figure 7:
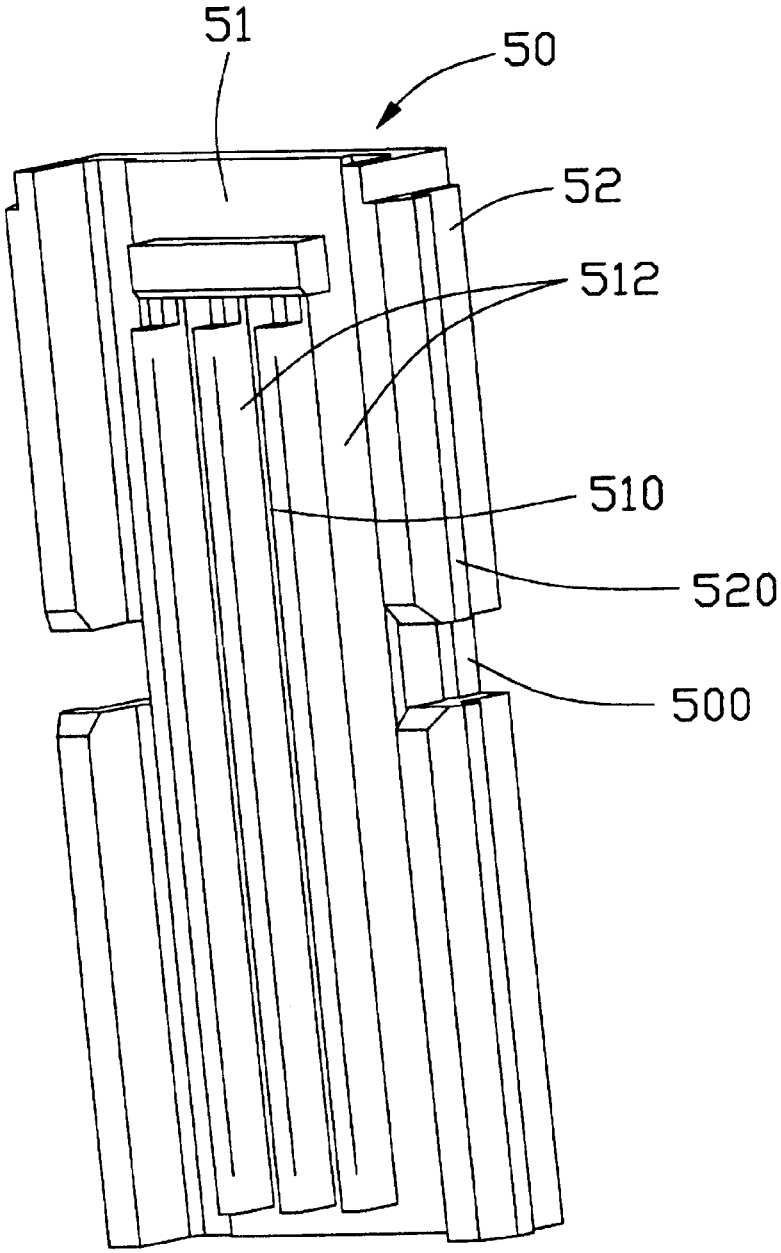
FIG. 7 is an enlarged, perspective view of the spacer.

Referring to FIGS. 6 and 7, the spacer 50 for fixing the second right-angle bent tails 314 includes a rear panel 51, a pair of side arms 52 extending forwardly from opposite ends of the rear panel 51. The rear panel 51 has a plurality of vertical projections 510 formed on an inner face thereof, and a plurality of channels 512 formed by the projections 510. An outwardly extending stick 520 is formed on one of the side arms 52 for being received and retained in the channel of the main housing 10. A cavity (not shown) is defined in another side arm 52 for receiving the rib 172 of the main housing 10. The spacer 50 also defines a pair of depressions 500 in a middle portion of the side arms 52.

Figure 8:
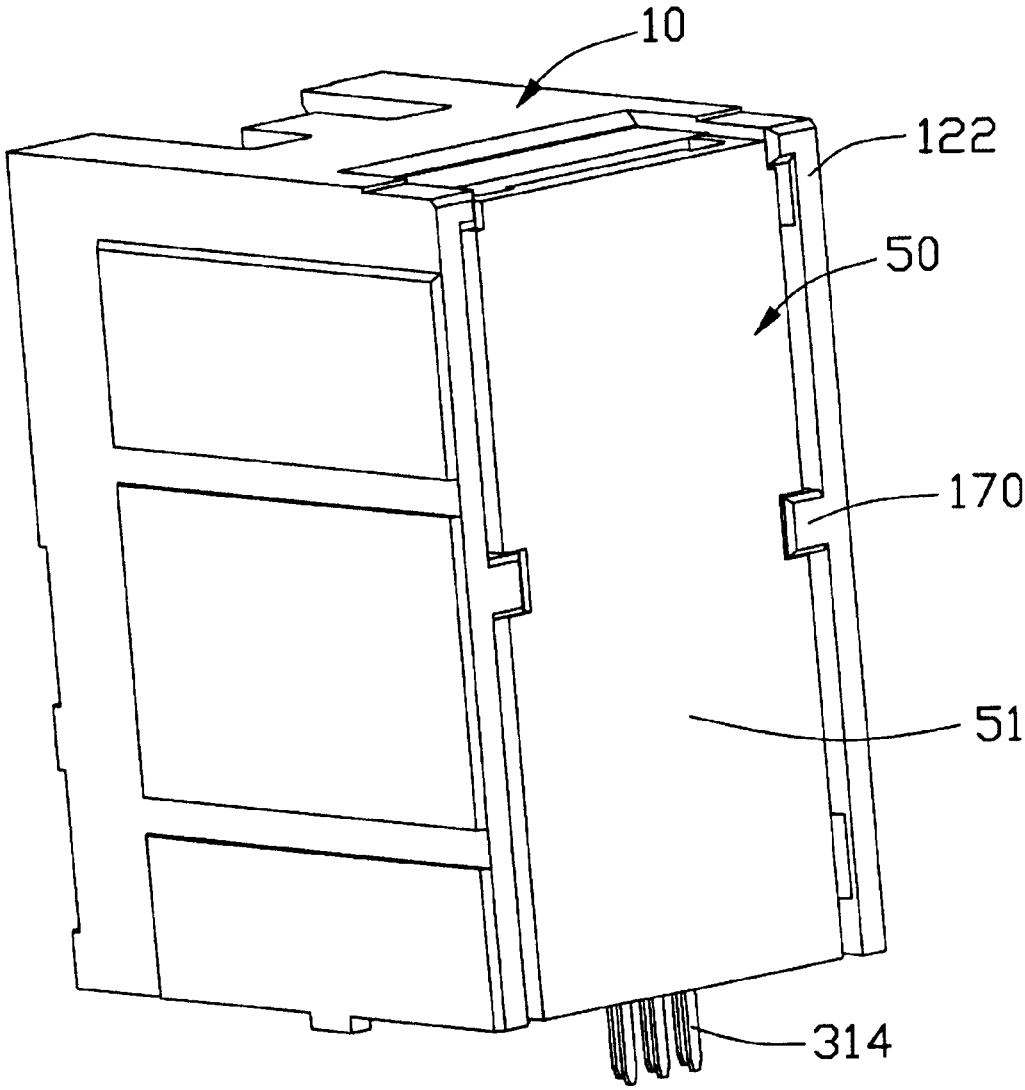
FIG. 8 is a perspective view of the staked connector assembly prior to assembly of the outer shield, showing the spacer completely connected to the housing.

Referring to FIGS. 8 and 9, in assembly, the spacer 50 is assembled to the concavity 18 from a rear face 122 of the main housing 10. The bumps 170 on the side faces 188 of the concavity 18 are received in the depressions 500 of the spacer 50 to restrain movement of the spacer 50 in a vertical direction. The stick 520 on the spacer 50 is received in the channel of the main housing 10; and the rib 172 on the main housing 10 is received in the cavity of the spacer 50, thereby fixing the spacer 50 against movement in a front-to-rear direction. Therefore, the spacer 50 is fixedly connected to the main housing 10. At the same time, the projections 510 of the spacer 50 abut against the second right-angle bent tails 314 that are received in the inner recesses 182 of the main housing 10, and inside faces 5120 (FIG. 9) of the channels 512 of the spacer 50 abut against the second right-angle bent tails 314 that are received in the outer recesses 180 of the main housing 10. Thus, the second right-angle bent tails 314 of the second terminals 31 are snugly sandwiched between the main housing 10 and the spacer 50.

Thereafter, the outer shield 40 is attached to the main housing 10. The outer shield 40 includes a front shield 41 and a rear shield 42. The front shield 41 has a front wall 410 along the mating face 100 and is appropriately apertured to expose the IEEE 1394 receiving cavity 110 and the USB receiving cavities 112, 114, and a top wall 412 with a pair of first outstandings 4120 formed at a free end thereof. The front wall 410 of the front shield 41 defines a plurality of holes 4100 on opposite sides thereof. The rear shield 42 includes a rear wall 420, a pair of forwardly extending side walls 422, and a flap 424 extending forwardly from a top edge of the rear wall 420. The flap 424 defines a pair of holes 4240 for receiving the first outstandings 4120 of the front shield 41. The side walls 422 of the rear shield 42 has a plurality of second outstandings 4220 formed at free ends thereof for being received and retained in the holes 4100 of the front shield 41, and a plurality of downwardly extending ground legs 4222 extending beyond the board-mounting face 102 for initial board retention and for electrical connection with the ground circuits of the printed circuit board. The rear wall 420 of the outer shield 40 abuts against the rear panel 51 of the spacer 50 to further ensure a reliable connection between the spacer 50 and the main housing 10, thereby further ensuring a stable retention of the second terminals 31.

An inner surface of the front wall 410 of the outer shield 40 is abutted by outturned flanges 268 of the outer shield 26 of the USB component 20 which is surrounding the first aperture 13 and aligned with the USB receiving cavities 112, 114, and is also abutted by outturned flanges 321 of the IEEE 1394 shield 32 which is surrounding the second aperture 14 and aligned with the IEEE 1394 receiving cavity 110. Bottom flange 4104 (FIG. 9) extends rearwardly from a bottom edge of the front wall 410 to retain a lower front portion of the USB component 20 in the stacked connector assembly 1.

As described above, the second right-angle bent tails 314 of the second terminals 31 are received in the outer and the inner recesses 180, 182 of the main housing 10, then the spacer 50 is fixedly connected to the main housing 10. Thus, the terminals 31 can be accurately and reliably retained in the main housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked connector assembly mounted on a printed circuit board, comprising:

an insulative housing defining a first aperture and a second aperture over the first aperture in a mating face thereof, and a plurality of recesses in a rear face thereof;

a first electrical connector disposed in the first aperture and including at least one first receiving cavity in communication with the mating face of the housing, and a first array of terminals having first contacting portions extending into the at least one first receiving cavity and first right-angle bent tails for electrical connection with a printed circuit board;

a second electrical connector disposed in the second aperture and including a second receiving cavity in communication with the mating face of the housing and a second array of terminals having second contacting portions extending into the second receiving cavity and second right-angle bent tails received in the recesses of the housing for electrical connection with a printed circuit board; and a spacer fixed to the housing and retaining the second right-angle bent tails of the second terminals in the housing; wherein the housing defines a concavity in the rear face for accommodating the spacer; wherein the recesses comprises a plurality of staggered inner and outer recesses in communication with the concavity, and wherein the second light-angle bent tails are received in the inner and the outer recesses in a staggered manner; wherein the spacer comprises a plurality of projections abutting against the second right-angle bent tails that arm received in the inner recesses of the housing, and a plurality of channels having inside faces for abutting against the second right-angle bent tails that are received in the outer recess; wherein the spacer includes a rear panel and a pair of side arms extending forwardly from opposite ends of the rear panel, the projections being formed on an inner face of the rear panel along a vertical direction and the channels being formed by the projections.

2. The stacked connector assembly as claimed in claim 1, wherein the spacer defines a pair of depressions in the side arms, and wherein the housing has a pair of bumps formed on opposite side faces of the concavity for being received in the depressions.

3. The stacked connector assembly as claimed in claim 1, wherein the first connector is a stacked Universal Serial Bus Connector (USB) defining two USB receiving cavities along the mating face of the housing.

4. The stacked connector assembly as claimed in claim 1, further comprising an inner shield surrounding the second aperture and defining an IEEE 1394 receiving cavity along the mating face of the housing.

5. The stacked connector assembly as claimed in claim 4, wherein the housing has an extension disposed in the shield and defining a plurality of passageways in a top and a bottom faces thereof for receiving the second contacting portions of the second terminals.

* * * * *